US011105180B2

(12) United States Patent
Al-Mousa et al.

(10) Patent No.: US 11,105,180 B2
(45) Date of Patent: Aug. 31, 2021

(54) PLUGGING FORMATION FRACTURES

(71) Applicant: Saudi Arabian Oil Company, Dhahran (SA)

(72) Inventors: Ahmed Al-Mousa, Dhahran (SA); Marius Neacsu, Dhahran (SA); Ahmed A. Al-Ramadhan, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/544,472

(22) Filed: Aug. 19, 2019

(65) Prior Publication Data

US 2021/0054716 A1 Feb. 25, 2021

(51) Int. Cl.

| | |
|---|---|
| ***E21B 33/134*** | (2006.01) |
| ***E21B 33/136*** | (2006.01) |
| ***E21B 33/138*** | (2006.01) |
| ***E21B 33/13*** | (2006.01) |
| ***E21B 33/126*** | (2006.01) |
| *E21B 41/00* | (2006.01) |

(52) U.S. Cl.

CPC ..... *E21B 33/13* (2013.01); *E21B 33/126* (2013.01); *E21B 33/134* (2013.01); *E21B 33/136* (2013.01); *E21B 33/138* (2013.01); *E21B 41/0042* (2013.01); *E21B 2200/01* (2020.05)

(58) Field of Classification Search

CPC ..... E21B 33/134; E21B 33/136; E21B 33/138
See application file for complete search history.

(56) References Cited

U.S. PATENT DOCUMENTS

| | | | | |
|---|---|---|---|---|
| 2,047,774 A * | 7/1936 | Greene | ..... | E21B 33/136 102/333 |
| 2,708,973 A * | 5/1955 | Twining | ..... | E21B 33/134 166/285 |
| 3,376,934 A * | 4/1968 | William | ..... | E21B 33/138 166/193 |
| 4,422,948 A | 12/1983 | Corley et al. | | |

(Continued)

FOREIGN PATENT DOCUMENTS

| | | |
|---|---|---|
| CA | 2734032 | 6/2016 |
| WO | WO 2019027830 | 2/2019 |

OTHER PUBLICATIONS

PCT International Search Report and Written Opinion in International Appln. No. PCT/US2020/046779, dated Oct. 13, 2020, 14 pages.

*Primary Examiner* — Cathleen R Hutchins
(74) *Attorney, Agent, or Firm* — Fish & Richardson P.C.

(57) ABSTRACT

A method of plugging a formation fracture includes drilling, with a drill string configured to flow drilling fluid, a wellbore, where, at a downhole location, the drilling fluid is lost through a formation fracture. The method also includes deploying, through the drill string, a plugging assembly to the downhole location of the wellbore. The plugging assembly includes a flexible fiber sheet releasably coupled to a pumpable dart such that when the plugging assembly reaches the downhole location, the flexible fiber sheet is released from the dart to flow, with the drilling fluid, to the formation fracture to at least partially overlay the formation fracture. The method also includes adding, to the drilling fluid, lost circulation material configured to accumulate on a portion of the flexible fiber sheet to at least partially fluidically plug the formation fracture.

22 Claims, 10 Drawing Sheets

(56) References Cited

U.S. PATENT DOCUMENTS

| | | | | |
|---|---|---|---|---|
| 5,667,015 | A * | 9/1997 | Harestad | E21B 33/136 166/383 |
| 7,284,611 | B2 | 10/2007 | Reddy et al. | |
| 7,405,182 | B2 | 7/2008 | Verrett | |
| 8,002,049 | B2 | 8/2011 | Keese et al. | |
| 9,410,066 | B2 | 8/2016 | Ghassemzadeh | |
| 2012/0067447 | A1 * | 3/2012 | Ryan | E21B 33/138 138/97 |
| 2013/0296199 | A1 | 11/2013 | Ghassemzadeh | |
| 2014/0231068 | A1 | 8/2014 | Isaksen | |
| 2016/0160106 | A1 | 6/2016 | Jamison et al. | |
| 2018/0030809 | A1 * | 2/2018 | Harestad | E21B 23/10 |

* cited by examiner

PLUGGING FORMATION FRACTURES

FIELD OF THE DISCLOSURE

This disclosure relates to preventing lost circulation in wellbores during drilling operations.

BACKGROUND OF THE DISCLOSURE

Lost circulation occurs when drilling fluid such as drilling mud flows into one or more fractures of geological formations instead of returning up the annulus of the wellbore. Lost circulation can cause mud waste, dry drilling, and other downhole problems. Preventing lost circulation can save time and resources by keeping the drilling mud from leaving through formation fractures.

SUMMARY

Implementations of the present disclosure include a method that includes drilling, with a drill string configured to flow drilling fluid, a wellbore, where at a downhole location the drilling fluid is lost through a formation fracture. The method also includes deploying, through the drill string, a plugging assembly to the downhole location of the wellbore. The plugging assembly includes a flexible fiber sheet releasably coupled to a pumpable dart such that when the plugging assembly reaches the downhole location, the flexible fiber sheet is released from the dart to flow, with the drilling fluid, to the formation fracture to at least partially overlay the formation fracture. The method also includes adding, to the drilling fluid, lost circulation material configured to accumulate on a portion of the flexible fiber sheet to at least partially fluidically plug the formation fracture.

In some implementations, the flexible fiber sheet is wrapped and configured to unwrap at the downhole location. Adding the lost circulation material includes adding the lost circulation material such that the lost circulation material reaches the downhole location after the flexible sheet is released from the pumpable dart.

In some implementations, the flexible fiber sheet is configured to form a bridge at the formation fracture for lost circulation material to pile on the flexible fiber sheet and form a fluid plug. Adding the lost circulation material includes adding the lost circulation material such that the lost circulation material reaches the downhole location after the flexible sheet forms a bridge at the formation fracture.

In some implementations, adding the lost circulation material includes adding the lost circulation material to the drilling fluid and circulating the drilling fluid in and out of the wellbore.

In some implementations, the flexible fiber sheet is releasably coupled to the pumpable dart with a gel dissolvable in the drilling fluid at the downhole location, and where the flexible fiber sheet is configured to separate from the pumpable dart when the dissolvable gel is dissolved in the drilling fluid. Adding the lost circulation material includes adding the lost circulation material such that the lost circulation material reaches the downhole location after the gel is dissolved and the flexible sheet is disengaged from the pumpable dart.

In some implementations, the flexible fiber sheet is folded about a pin of the pumpable dart to engage with the dart. Adding the lost circulation material includes adding the lost circulation material such that the lost circulation material reaches the downhole location after the flexible fiber sheet is unfolded from the pin and disengaged from the dart.

In some implementations, the dissolvable gel is disposed inside a pill that covers the plugging assembly. The pill includes fluid configured to prevent the dissolvable gel from completely dissolving before exciting the drill string, the pill configured to be lost at the downhole location to expose the plugging assembly to the drilling fluid. Adding the lost circulation material includes adding the lost circulation material such that the lost circulation material reaches the downhole location after the gel is dissolved and the flexible sheet is disengaged from the pumpable dart.

In some implementations, the fluid of the pill includes an inhibited fluid polymer. Adding the lost circulation material includes adding the lost circulation material such that the lost circulation material reaches the downhole location after the inhibited fluid polymer is lost at the downhole location and the gel is dissolved.

In some implementations, deploying the plugging assembly includes disposing, inside a surface pumping head, the plugging assembly, and flowing, though a first portion of the pumping head downstream of the plugging assembly, a first portion of the pill. Deploying the pumping assembly also includes moving the plugging assembly away from the surface pumping head toward the first portion of the pill, flowing, through a second portion of the pumping head upstream of the plugging assembly, a second portion of the pill to cover the plugging assembly, and pumping, with the drilling fluid, the pumping assembly with the first and second portions of the pill.

In some implementations, the flexible fiber sheet includes pores to allow part of the drilling fluid to pass through the flexible fiber sheet into the formation fracture when the flexible fiber sheet is at the formation fracture, and where adding the lost circulation material includes adding the lost circulation material such that the lost circulation material flows, with the drilling fluid, to the flexible fiber sheet to accumulate on the flexible fiber sheet and form a fluid plug.

Implementations of the present disclosure also include a wellbore plugging assembly that includes a dart configured to be pumped through a drill string disposed at the wellbore, the dart configured to leave the drill string at or near a downhole location where drilling fluid is lost through a formation fracture. The assembly also includes a flexible fiber sheet releasably coupled to the dart such that when the wellbore plugging assembly reaches the downhole location, the flexible fiber sheet is released from the dart to flow, with the drilling fluid, to the formation fracture to at least partially overlay the formation fracture. The flexible fiber sheet is configured to form a bridge at the formation fracture for lost circulation material to accumulate on a portion of the flexible fiber sheet to at least partially fluidically plug the formation fracture.

In some implementations, the flexible fiber sheet is wrapped to form a longitudinally continuous strip. The flexible fiber sheet is configured to unwrap at the downhole location upon leaving the drill string and being exposed to the drilling fluid, before reaching the formation fracture.

In some implementations, the flexible fiber sheet includes pores to allow part of the drilling fluid to pass through the flexible fiber sheet into the formation fracture when the flexible fiber sheet is at the formation fracture, such that the lost circulation material flows, with the drilling fluid, to the flexible fiber sheet to accumulate on the flexible fiber sheet and form a fluid plug.

In some implementations, the flexible fiber sheet is releasably coupled to the dart with a gel dissolvable in the drilling fluid at the downhole location, and where the flexible fiber sheet is configured to separate from the pumpable dart when the dissolvable gel is dissolved in the drilling fluid.

In some implementations, the flexible fiber sheet is folded about a pin of the pumpable dart to engage with the dart.

In some implementations, the dissolvable gel is disposed inside a pill that covers the plugging assembly, the pill including fluid configured to prevent the dissolvable gel from completely dissolving before exciting the drill string, the pill configured to be lost at the downhole location to expose the plugging assembly to the drilling fluid.

In some implementations, the fluid of the pill includes an inhibited fluid polymer configured to be lost at the downhole location to expose the dissolvable gel to the drilling fluid.

Implementations of the present disclosure include a fluid loss plugging system that includes a dart, the dart configured to be pumped through a drill string disposed at a wellbore, the dart configured to leave the drill string at or near a downhole location where drilling fluid is lost through a formation fracture. The system also includes a flexible fiber sheet releasably coupled to the dart such that when the plugging assembly reaches the downhole location, the flexible fiber sheet is released from the dart to flow, with the drilling fluid, to the formation fracture to at least partially overlay the formation fracture. The system also includes lost circulation material, the lost circulation material configured to flow through the drill string to the downhole location and to the formation fracture to accumulate on a portion of the flexible fiber sheet to at least partially fluidically plug the formation fracture.

In some implementations, the flexible fiber sheet is wrapped or twisted to form a longitudinally continuous strip, the flexible fiber sheet configured to unwrap or untwist at the downhole location upon leaving the drill string and being exposed to the drilling fluid, before reaching the formation fracture.

In some implementations, the flexible fiber sheet is releasably coupled to the dart with a gel dissolvable in the drilling fluid at the downhole location such that the flexible fiber sheet separates from the pumpable dart when the dissolvable gel is dissolved in the drilling fluid.

DETAILED DESCRIPTION OF THE DISCLOSURE

During the drilling of a wellbore 114, lost circulation or loss of circulation can occur when drilling fluid 160 (for example, drilling mud) enters a naturally fractured formation or an induced fracture. The present disclosure relates to a wellbore plugging assembly 100 and methods for preventing drilling fluid 160 from leaving the wellbore through fractures (for example, large fractures) of the formation. The plugging assembly 100 is used to create a bridge at the formation fracture or fractures for lost circulation material (for example, organic or synthetic particles) to pile up and form a fluid plug. Such a pile of lost circulation material can and stop or reduce the losses in large formation fractures.

Implementations of the present disclosure may realize one or more of the following advantages. For example, the well system can save time and resources by preventing drilling mud from leaving the wellbore through large fractures of the formations. The present disclosure features a system that is compatible with multiple types of wellbore fluids (for example, water-based-mud, oil-based-mud, brine, or cement slurry). Additionally, the system can be used to stop losses before running the casing which enhances the cementing operation of wellbore casing to increase the life of the well and prevent any behind casing communication. The system can also be quickly deployed without the need of specialized personnel.

Figure 1:
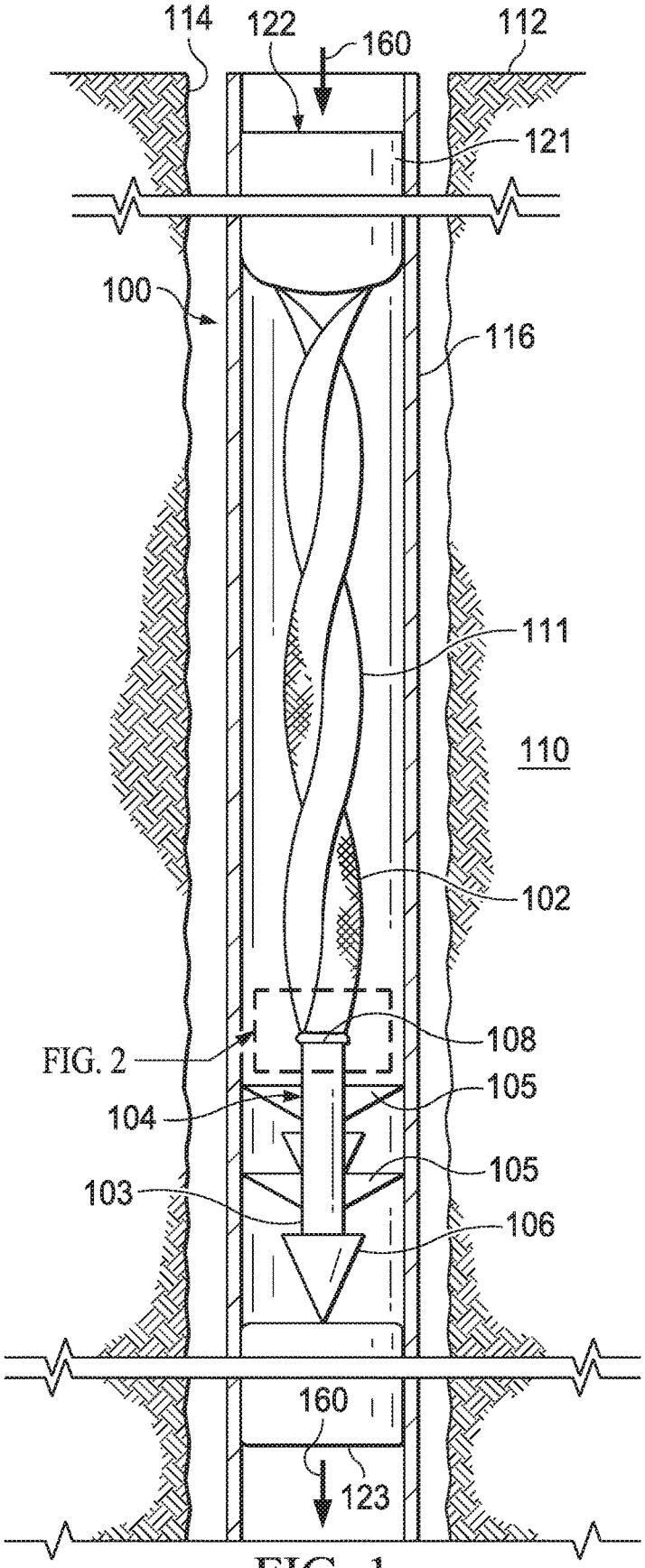
FIG. 1 is a partial cross sectional view of a plugging assembly disposed inside a drill string in a wellbore.

FIG. 1 illustrates a wellbore plugging assembly 100 that includes a dart 104 (for example, a pumpable dart) that can be pumped, with the drilling fluid 160, through a drill string 116 disposed at the wellbore 114. As further described later with respect to FIGS. 4-7, the dart 104 is pumped, using drilling fluid, inside the drill string to an outlet of the drill string 116 at or near a downhole location where drilling fluid is lost through a formation fracture. The dart 104 can be a flexible dart made of rubber or a similar material. The dart includes a shaft 103 with a tip 106 at a leading end and a back end 108 attachable to a flexible fiber sheet 102 of the plugging assembly 100. The dart has radial cups or guides 105 that extend from the shaft 103 and have an outside diameter corresponding generally to the inside diameter of the drill string 116. The flexible fiber sheet 102 is releasably coupled to the dart 104 such that when the plugging assembly reaches the downhole location, the flexible fiber sheet is released from the dart 104 to flow, with the drilling fluid 160, to the formation fracture to at least partially overlay the formation fracture.

The flexible fiber sheet 102 can be a fine fiber mesh, having a fine crisscross pattern of fiberglass threads like silk. The flexible fiber sheet 102 can provide high shear resistance to withstand fluidic pressure and form a proper bridge for lost circulation material to accumulate and form a fluid plug at the formation fracture. The sheet 102 forms a base at the formation fracture for any fluid-loss control material (LCM) or loss circulation material such as a granular material to build up and form a plug. The flexible fiber sheet 102 is wrapped, twisted, or wrung to form a longitudinally continuous strip or rope 111. The wrapped flexible fiber sheet 102 can be glued or adhered to itself with a dissolvable adhesive or gel 113 (shown in FIG. 2) that dissolves with the drilling fluid at the downhole location to unwrap or untwist at the downhole location after leaving the drill string. The sheet 102 unwraps after being exposed to the drilling fluid but before reaching the formation fracture so that the sheet 102 covers all or a large part of the formation fracture.

Figure 2:
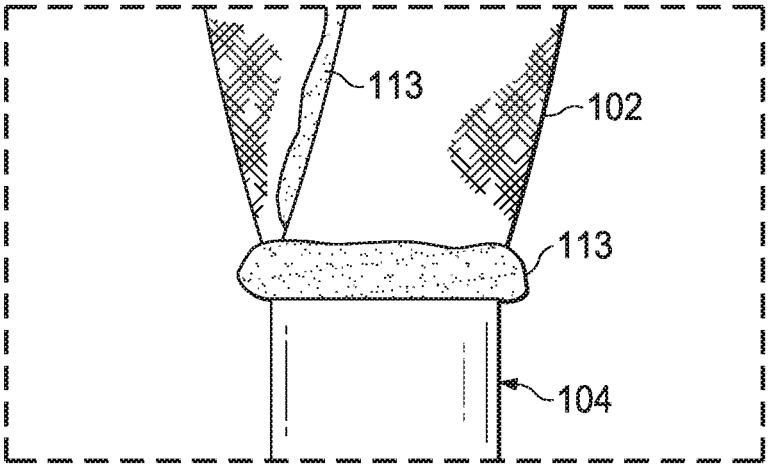
FIG. 2 is a detail view of a portion of the plugging assembly in FIG. 1.
Figure 3:
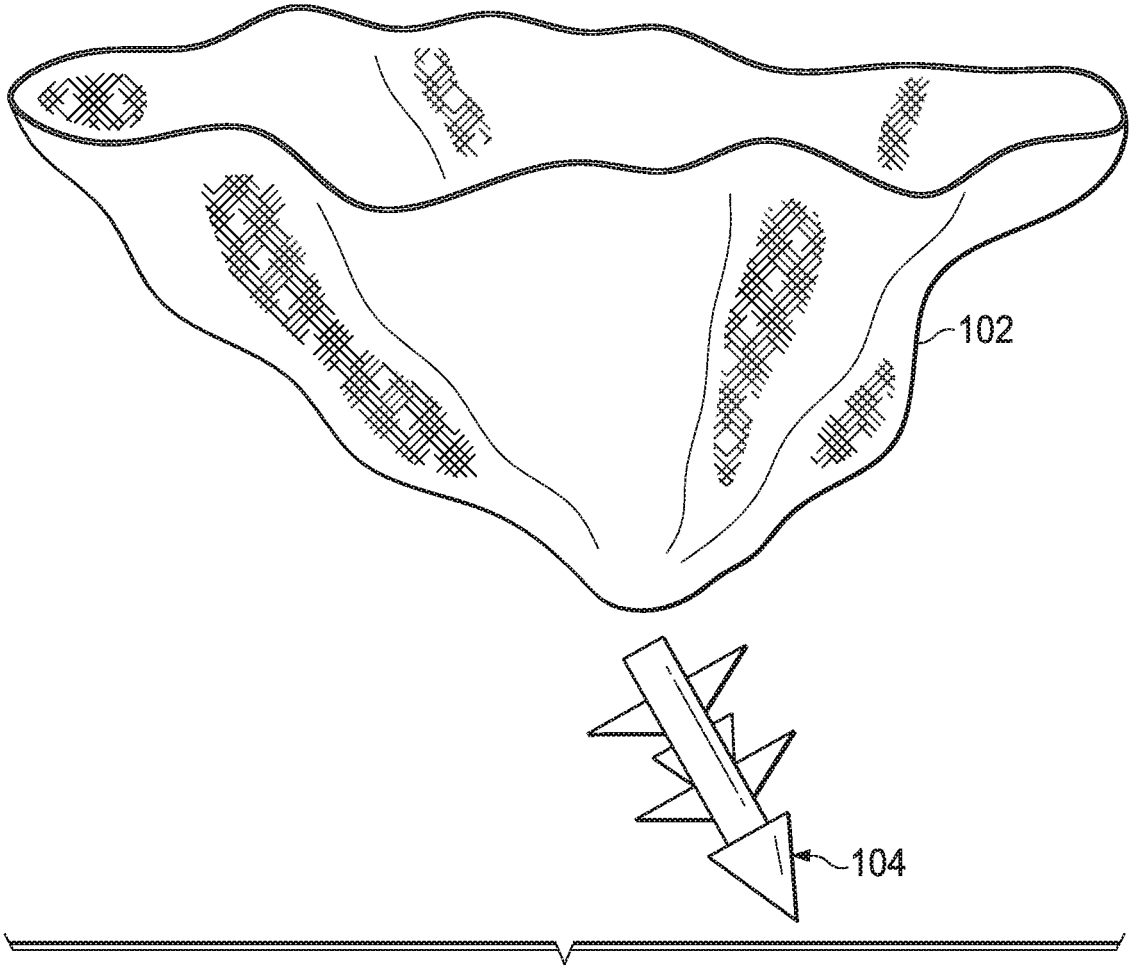
FIG. 3 is a perspective view of a flexible fiber sheet of the plugging assembly separated from a dart of the plugging assembly.

Referring to FIG. 1 and FIG. 2, the wellbore plugging assembly 100 also includes a pill 122 (for example, a viscous fluid non-dissolvable in drilling fluid 160) that protects a dissolvable gel or glue 113 that attaches the flexible fiber sheet 102 to the dart 104. Specifically, the flexible fiber sheet 102 can be releasably coupled to the pumpable dart 104 with a gel 113 that is dissolvable in the drilling fluid 160. The gel 113 is exposed to the drilling fluid 160 at the downhole location. For example, and as further described in detail later with respect to FIGS. 9-12, to prevent the gel 113 from being prematurely exposed (and thus dissolved) to the drilling fluid 160 in the drill string 116, the plugging assembly 100 is protected from the drilling fluid 160 on both ends by portions of the pill 122. Specifically, a first portion 123 (for example, half of the pill volume) of the pill 122 is pumped ahead of the plugging assembly 100, then the plugging assembly 100 is disposed inside the drill string 116, then a second portion 121 (for example, the remaining of the pill volume) of the pill 122 is pumped after the plugging assembly 100. The pill 122 can be made of an inhibited fluid polymer configured to be lost at the downhole location to expose the dissolvable gel 113 to the drilling fluid 160. The pill 122 thus prevents the gel 133 from dissolving or completely dissolving before exiting the drill string 116, where the gel 133 is exposed to the drilling fluid 160. As shown in FIG. 3, the flexible fiber sheet 102 separates from the pumpable dart 104 when the dissolvable gel 113 is dissolved in the drilling fluid 160

Figure 4:
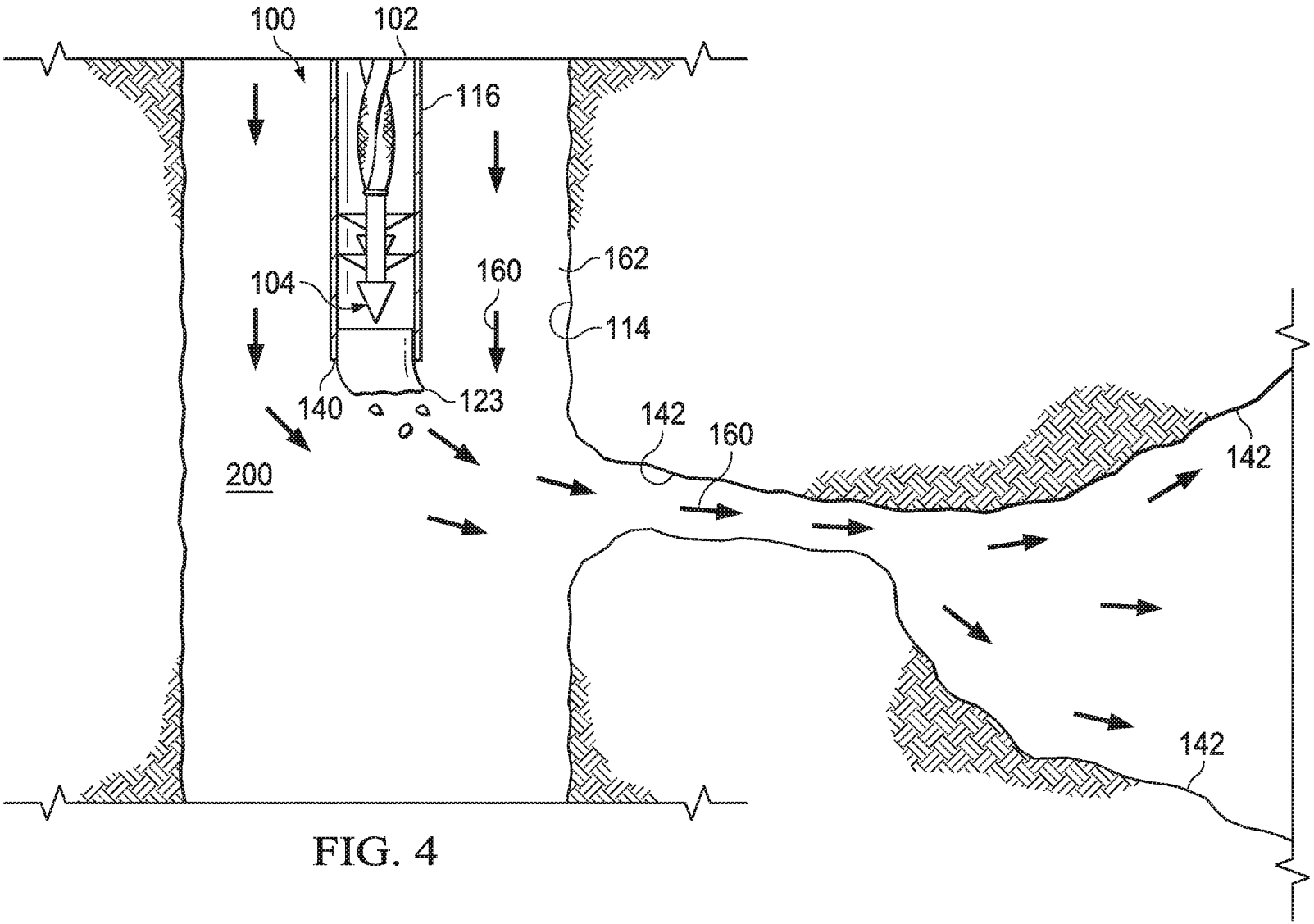
FIG. 4-FIG. 7 are sequential, schematic views of a plugging assembly deployed to a downhole location to plug a formation fracture.

FIGS. 4-7 show, sequentially, how the plugging assembly 100 works at the downhole location 200 to form a bridge at a formation fracture 142. Referring to FIG. 4, when the drilling fluid 160 is lost during drilling, the drilling fluid 160 leaves the wellbore through one or more formation fractures 142 instead of returning to the surface through the annulus 162. Upon determining that the drilling fluid 160 is being lost at the downhole location 200, the plugging assembly 100 can be deployed to the downhole location 200 through the drill string 116. At the downhole location 200, the drill string 116 has an outlet 140 through which the pill 123 and the plugging assembly leave the drill string 116. For example, the outlet 140 of the drill string 116 can include a fully open ended drill pipe. Because the flexible fiber sheet 102 is wrapped, the sheet 102 leaves the drill string 116 without getting caught at the outlet 140 of the trilling string 116 or at the joints of the drill string 116.

Figure 5:
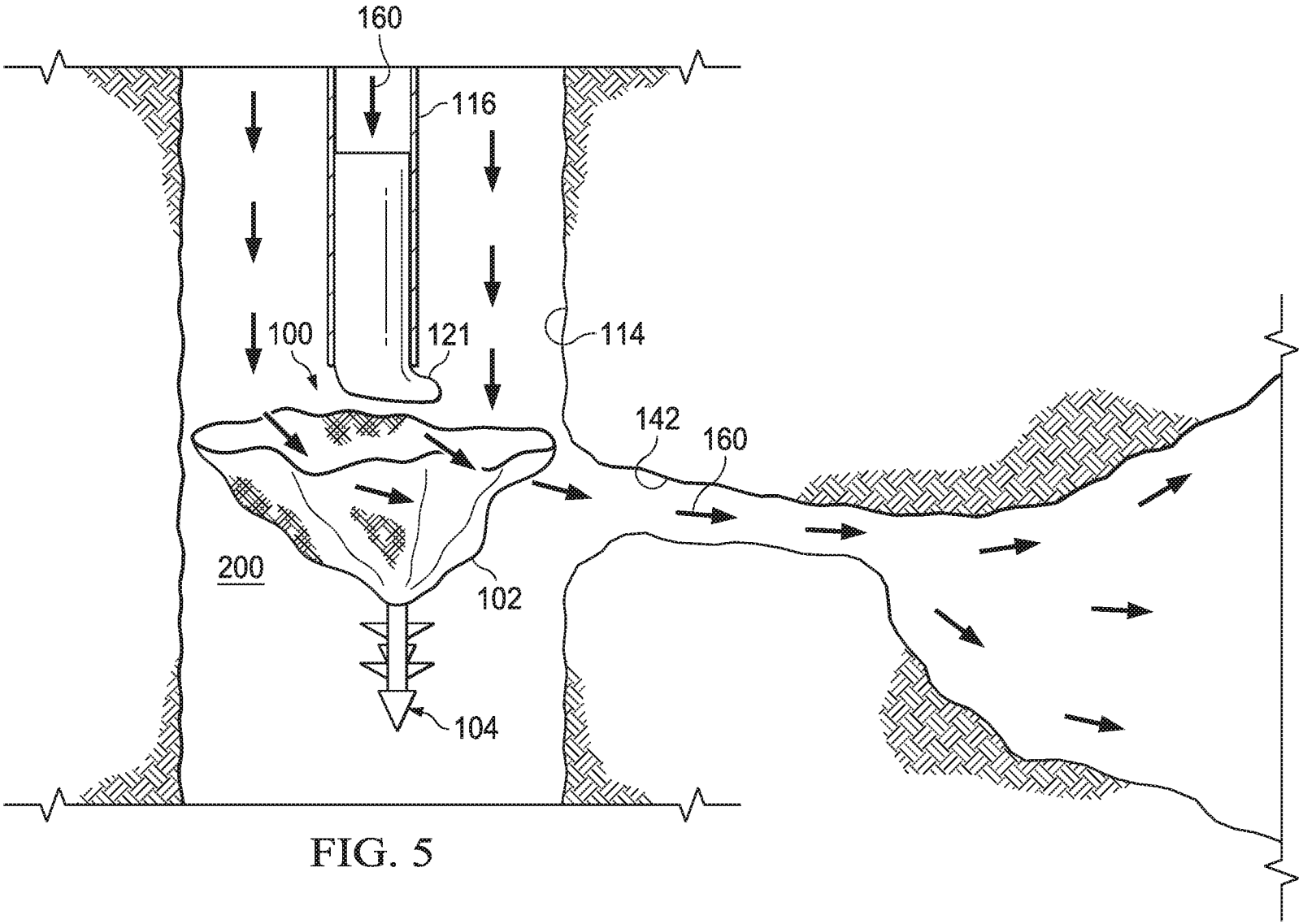

Referring to FIG. 5, after the plugging assembly 100 exits the drill string 116, the flexible fiber sheet 102 of the plugging assembly 100 unwraps and expands. At the downhole location 200, the first pill portion and the second pill portion 121 (for example, the viscous fluid of the pill) is lost in the drilling fluid 160 and the gel (see FIG. 2) connecting the dart 104 to the sheet 102 dissolves in the drilling fluid. When the gel dissolves, the flexible fiber sheet 102 separates from the dart 104. In some implementations, the flexible fiber sheet has a length of between 3-10 feet, and a width of between 3-10 feet. In some implementations, multiple plugging assemblies 100 can be pumped in sequence or separately to cover the fracture 142 if needed. Additionally, the length of the sheet 102 and the size of the dart 104 depends on the size of the hole being drilled and the size of the drill string 116. For example, smaller drilled holes and smaller drill strings 116 can require smaller darts 104 and shorter mesh sheets 102 to be easily pumped and deployed.

Figure 6:
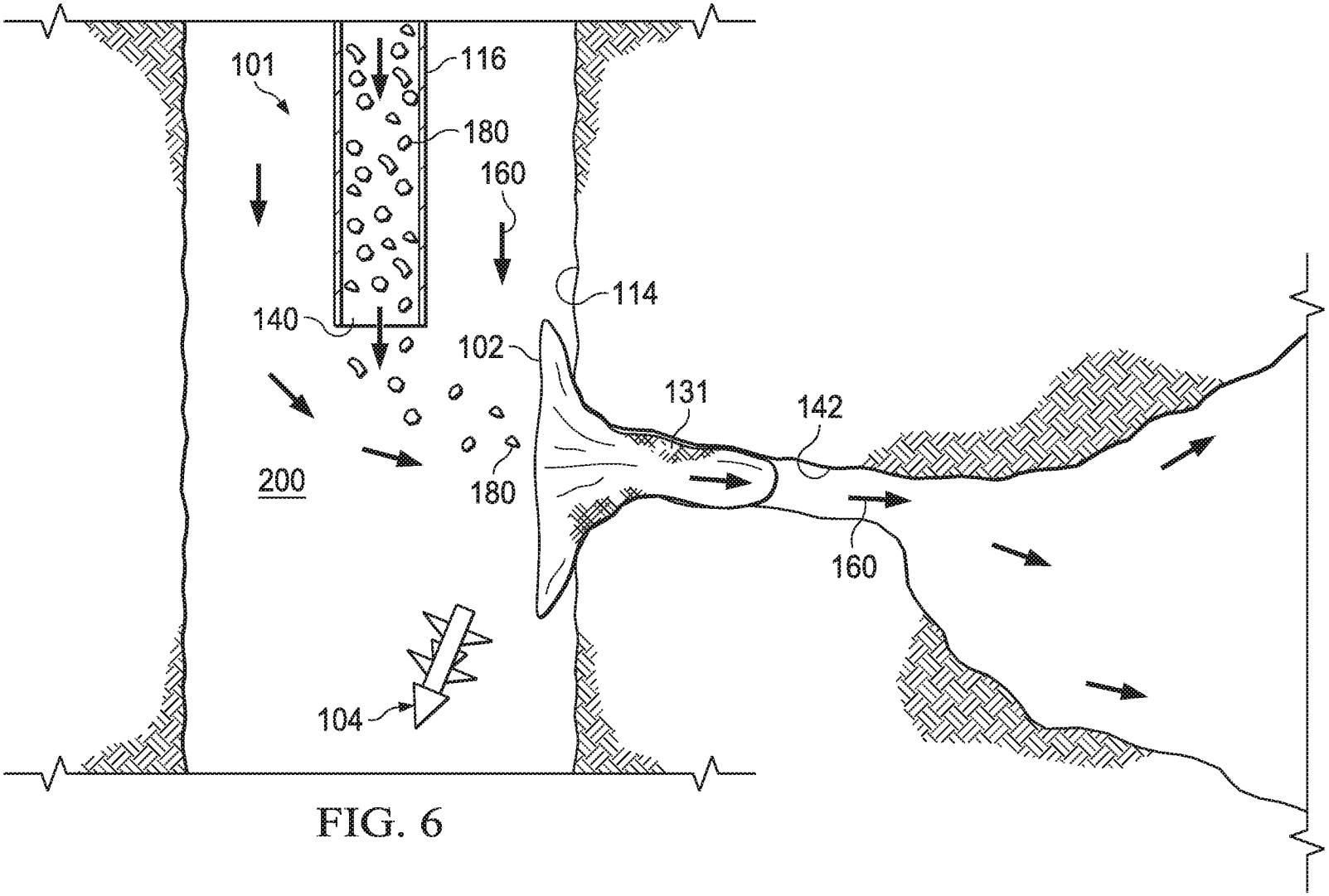
Figure 7:
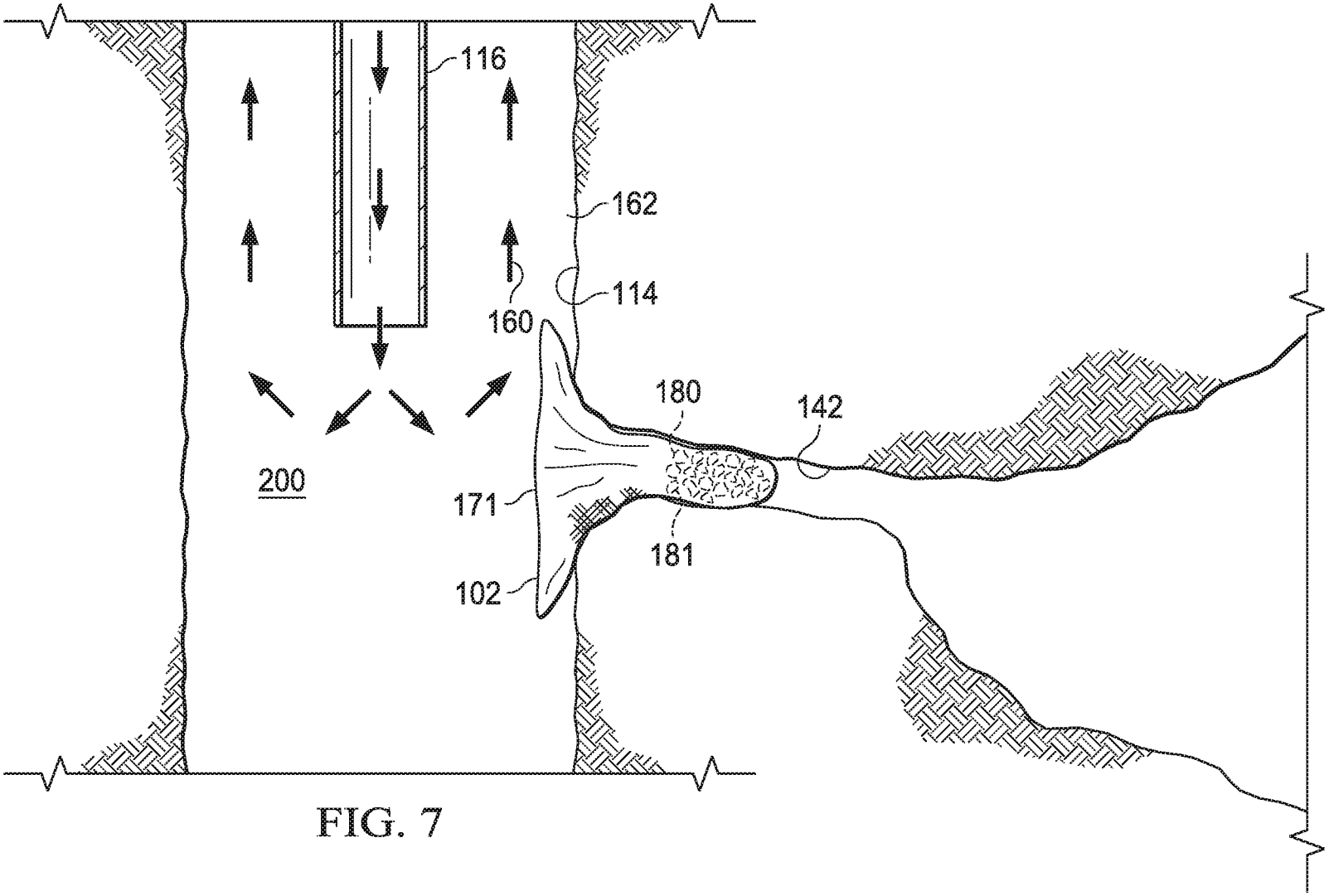

Referring now to FIG. 6, when the flexible fiber sheet 102 disengages from the dart and is expanded, the sheet 102 flows, with the drilling fluid 160, to the formation fracture 142 to at least partially overlay the formation fracture 142. After the plugging assembly 100 is sent to the downhole location 200, lost circulation material (LCM) 180 is added to the drilling fluid at the surface of the wellbore to flow through the drill string 116 to the downhole location 200 to form the fluid plug. For example, at the downhole location, the flexible fiber sheet 102 flows with the drilling fluid 160 into the fracture 142 and gets compacted at the fracture 142 to form a bridge for the lost circulation material 180 to accumulate. When the lost circulation material 180 leaves the drill string 116, the lost circulation material 180 flows to the flexible fiber sheet 102 with the drilling fluid 160. For example, the flexible fiber sheet 102 has pores 131 to allow part of the drilling fluid 160 to pass through the flexible fiber sheet 102 into the formation fracture 142 when the flexible fiber sheet 102 is at the formation fracture 142. By allowing fluid 160 to pass through the sheet 102, fluid directs at least part of the lost circulation material 180 to the sheet 102. The pores or openings 131 of the sheet are small enough to prevent the lost circulation material 180 from passing through the pores 131. As shown in FIG. 7, the lost circulation material 180 flows, with the drilling fluid, to the flexible fiber sheet 102 to accumulate on the flexible fiber sheet 102 and form a fluid plug 181. The flexible fiber sheet 102 forms a bridge 171 at the formation fracture 142 (for example, at the entrance of the formation fracture 142) where lost circulation material accumulates on a portion of the flexible fiber sheet 102 to at least partially fluidically plug the formation fracture 142 or the wellbore 114. Once the fracture 142 is plugged, the drilling fluid 160 flows back to the surface through the annulus 162 of the wellbore. In some implementations, the sheet 102 is large enough to cover a large formation fracture 142 that may be difficult or impossible to be cured or plugged by conventional methods (for example, without the flexible fiber sheet 102).

Figure 8:
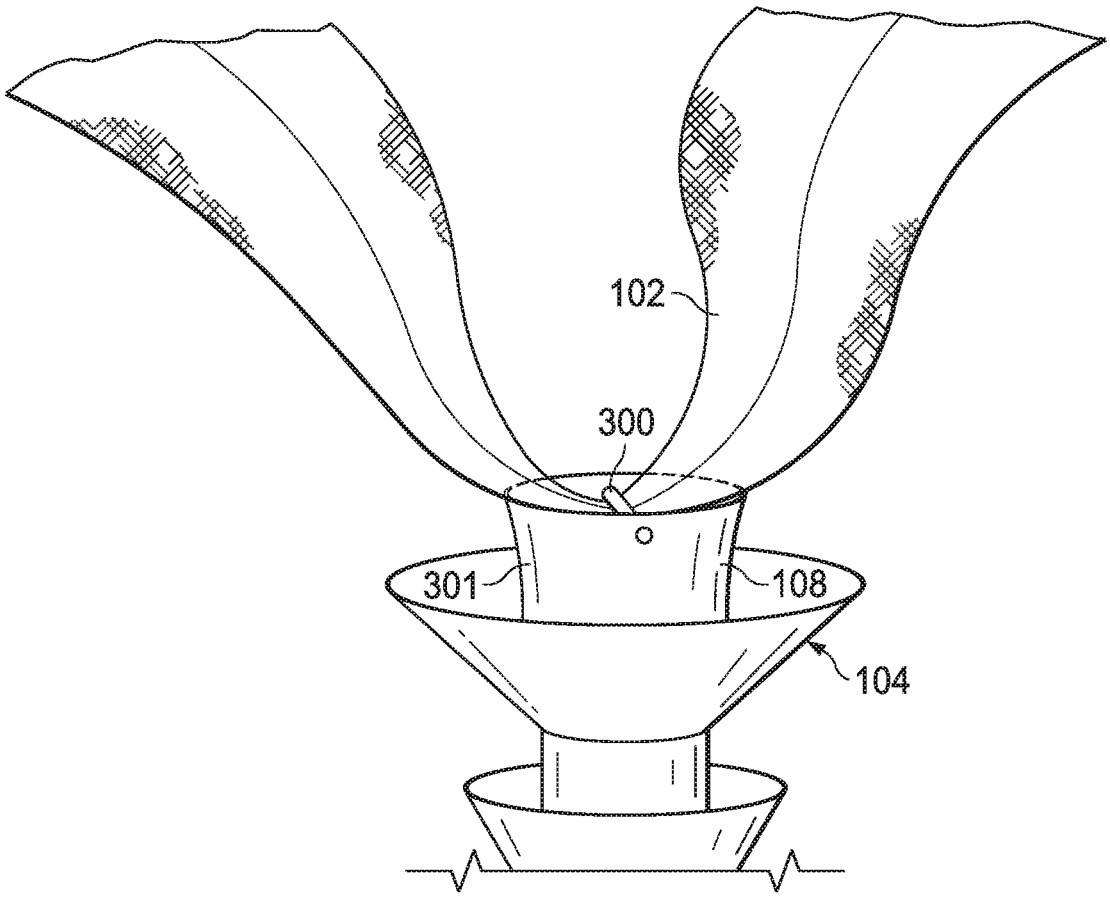
FIG. 8 is a perspective view of a portion of the plugging assembly according to implementations of the present disclosure.

FIG. 8 illustrates a different attachment configuration of the dart 104 and flexible sheet 102. The dart 104 includes a pin 300 at the back end 108 of the dart 104 to hold the flexible sheet 102. To attach the flexible sheet 102 to the dart 104, one end of the flexible sheet 102 is run inside a tubular body 301 of the dart 104 and underneath the pin 300, and pulled out from the other side of the tubular body 301 of the dart 104. The flexible sheet 102 is pulled further out and folded about the pin 200 such that both ends of the sheet 102 are generally equally far from the pin 300. After securing the sheet 102 to the dart 104, the sheet 102 is wrapped and the adhesive gel is applied to the sheet 102 to keep the sheet wrapped. Once the plugging assembly 100 reaches the downhole location (see FIG. 6), the gel dissolves and the sheet 102 is free to unwrap and be pulled out from the pin 30 by the fluid flow into the formation fracture.

Figure 10:
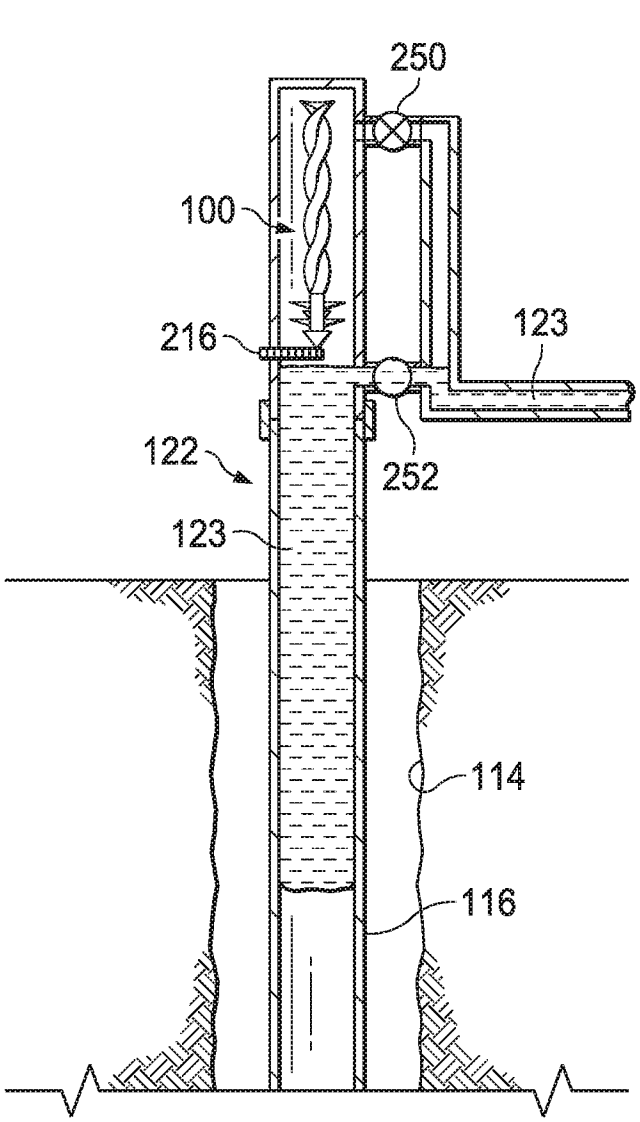
FIG. 9-FIG. 12 are sequential, schematic views of a deploying method of the plugging assembly.
Figure 9:
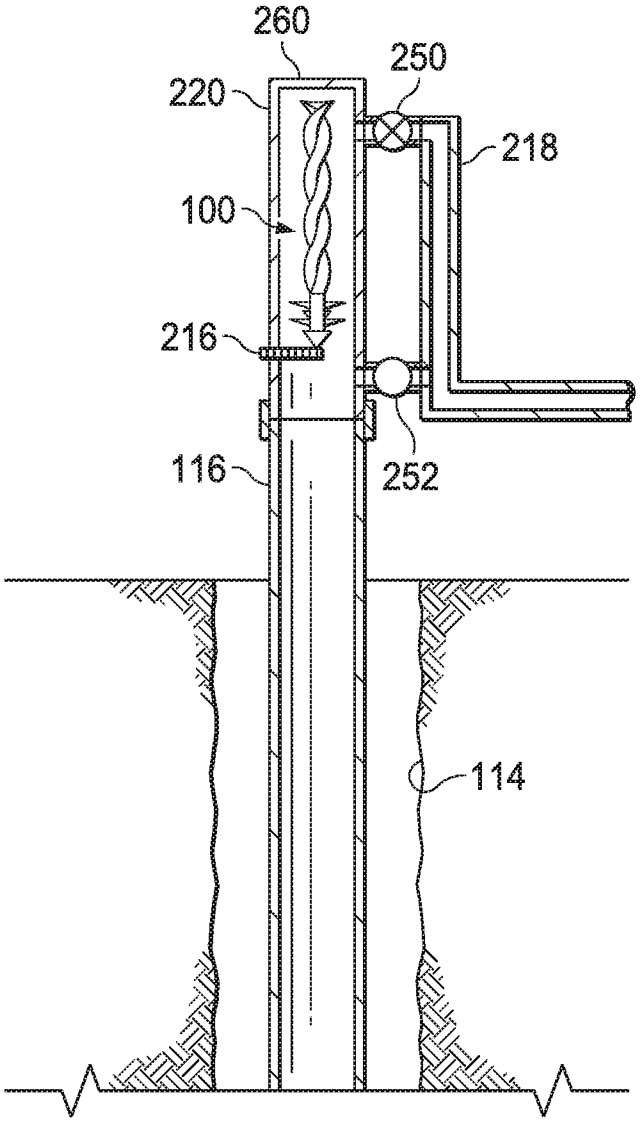
Figure 12:
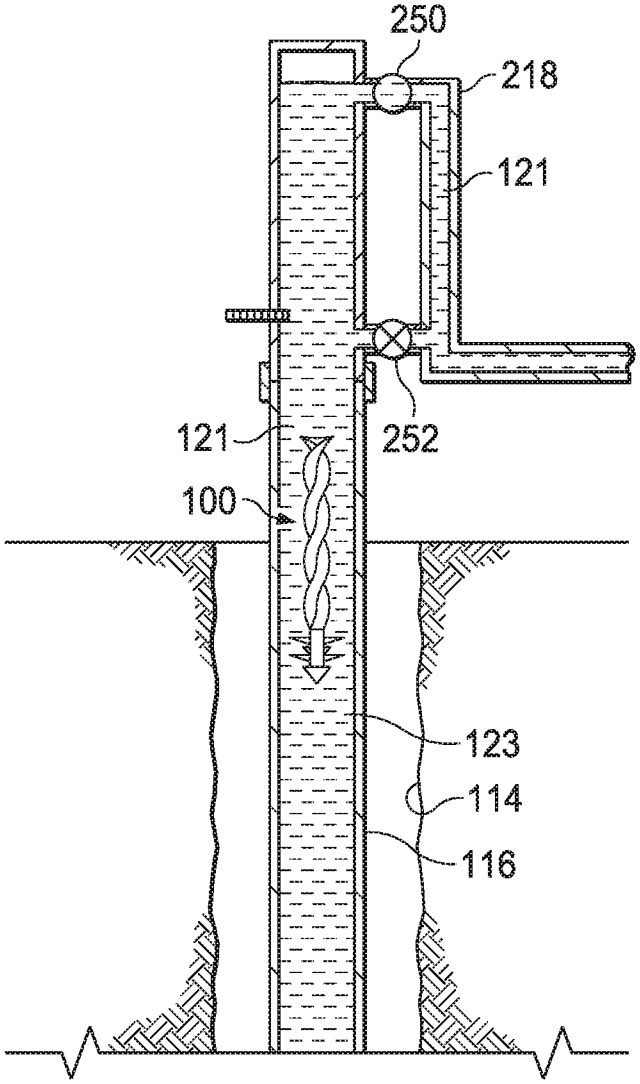
Figure 11:
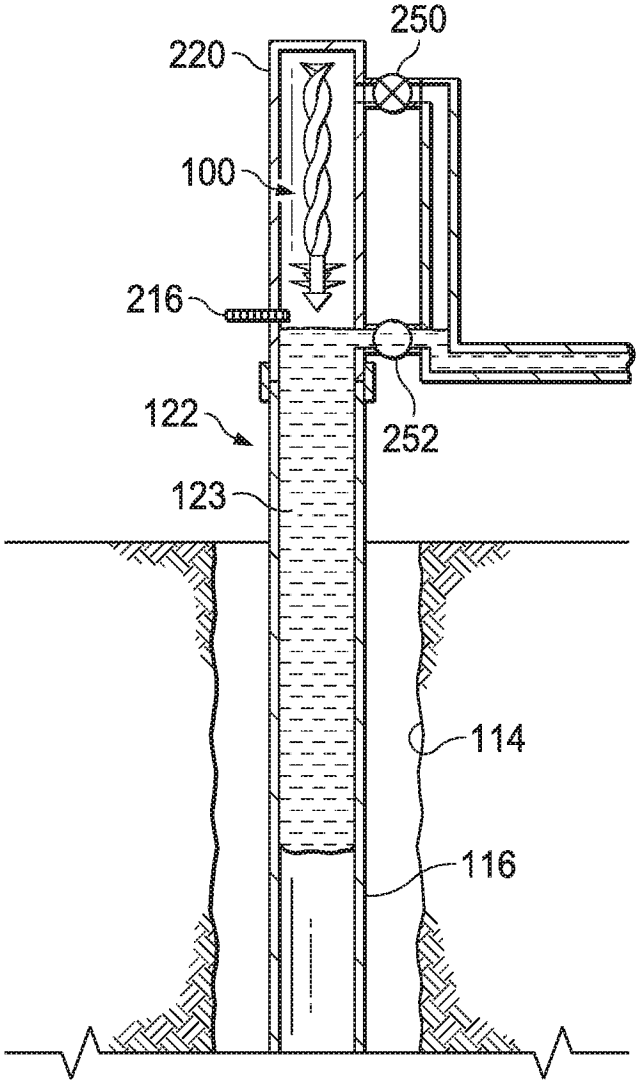

FIGS. 9-12 show a sequence of steps for deploying the plugging assembly 100 with the pill 122 according to implementations of the present disclosure. Referring to FIG. 1, the plugging assembly 100 is deployed using a surface pumping head 220 or a wellhead (for example, a cementing head) that includes a lower valve 252, an upper valve 250 near an inlet 260 of the pumping head 220, surface lines 218, and a release screw or pin 216. The plugging assembly 100 is placed inside the pimping head 220 above the screw 216 which holds the plugging assembly 100 in place. Referring to FIG. 10, the pill 122 is mixed at surface in the rig's mud tank (not shown) and pumped in the surface lines 218 to the lower valve 252 of the pumping head 220 with the upper valve 250 closed. A first portion 123 of the pill 122 is displaced ahead of the plugging assembly 100 and then the lower valve 252 is closed to stop the flow of the pill fluid. Referring to FIG. 11, the release screw 216 is retracted to allow the plugging assembly 100 to leave the pumping head 220 and enter the drill string 116. Referring to FIG. 12, upon or while moving the pumping assembly 100, the upper inlet valve 250 is opened and the second portion 121 or the rest of the pill 122 is pumped to move the plugging assembly 100. The second portion 121 of the pill 122 can cover the entire plugging assembly 100 or part of the plugging assembly 100. Once the pill 122 is fully pumped inside the drill string 116, the pill 122 and plugging assembly 100 are both pumped downhole by pumping the drilling fluid 160 inside the drill pipe to push the pill 122 and the plugging assembly 100 to the downhole location. The dissolvable gel can include a heavy grease or tar and the pill 122 can be a water based pill when the drilling fluid 160 is an oil-based-mud. The dissolvable gel can include a starch solution and the pill 122 can be an oil base pill when the drilling fluid 160 is a water-based fluid.

Figure 13:
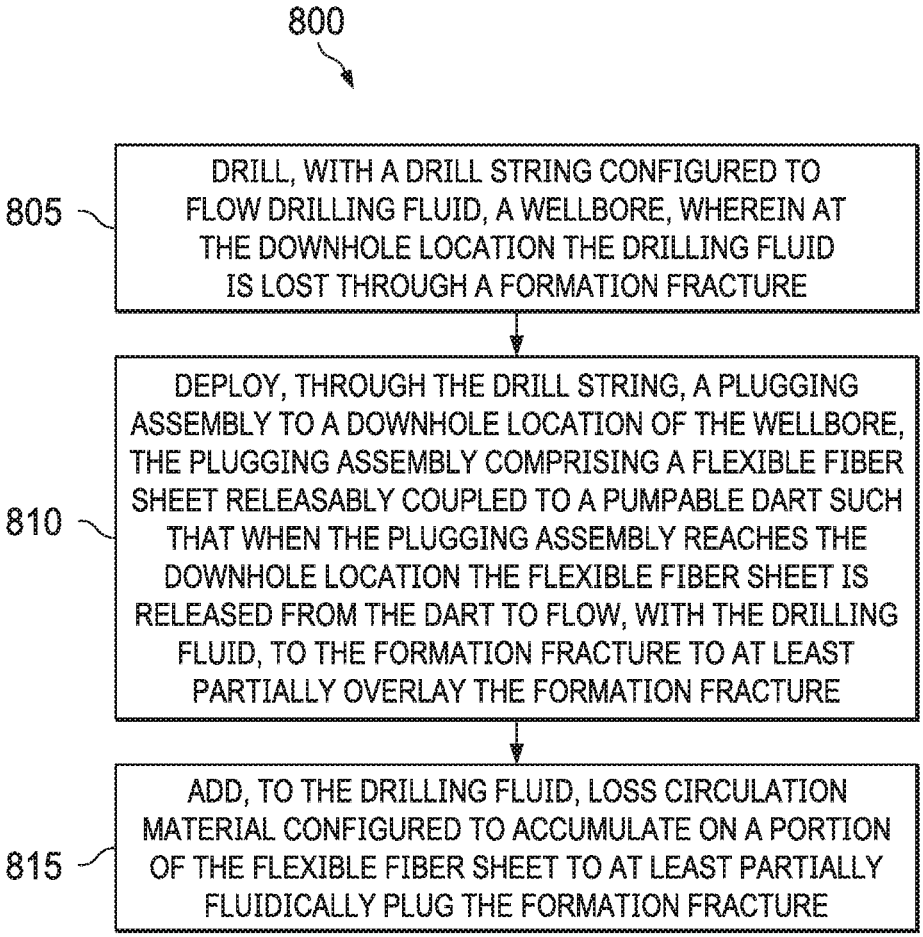
FIG. 13 shows a flow chart of an example method of plugging formation fractures.

FIG. 13 shows a flow chart of an example method 800 of plugging formation fractures. The method includes drilling, with a drill string configured to flow drilling fluid, a wellbore, where at the downhole location the drilling fluid is lost through a formation fracture (805). The method also includes deploying, through the drill string, a plugging assembly to a downhole location of the wellbore. The plugging assembly includes a flexible fiber sheet releasably coupled to a pumpable dart such that when the plugging assembly reaches the downhole location the flexible fiber sheet is released from the dart to flow, with the drilling fluid, to the formation fracture to at least partially overlay the formation fracture (810). The method also includes adding, to the drilling fluid, lost circulation material configured to accumulate on a portion of the flexible fiber sheet to at least partially fluidically plug the formation fracture (815).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

Ranges may be expressed in the present disclosure as from about one particular value, or to about another particular value or a combination of them. When such a range is expressed, it is to be understood that another implementation is from the one particular value or to the other particular value, along with all combinations within said range or a combination of them.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

That which is claimed is:

1. A method comprising:

drilling, with a drill string configured to flow drilling fluid, a wellbore, the drill string extending from an inlet of the drill string disposed at or near a surface of the wellbore to an outlet of the drill string disposed at or near a downhole location of the wellbore, wherein at the downhole location the drilling fluid is lost through a formation fracture of the wellbore; and deploying, through the drill string and with the drill string stationary with respect to the wellbore, a plugging assembly to the downhole location of the wellbore, the plugging assembly comprising a flexible fiber sheet releasably coupled to a pumpable dart such that when the plugging assembly reaches the downhole location the flexible fiber sheet is released from the dart to flow, with the drilling fluid, to the formation fracture to at least partially overlay the formation fracture, wherein deploying the pumping assembly comprises pumping, with the drilling fluid, the plugging assembly from the inlet of the drill string to the outlet of the drill string; and adding, to the drilling fluid, lost circulation material configured to accumulate on a portion of the flexible fiber sheet to at least partially fluidically plug the formation fracture.

2. The method of claim 1, wherein the flexible fiber sheet is wrapped and configured to unwrap at the downhole location after exiting the drill string and being exposed to the drilling fluid, and wherein adding the lost circulation material comprises adding the lost circulation material such that the lost circulation material reaches the downhole location after the flexible sheet is released from the pumpable dart.

3. The method of claim 1, wherein the flexible fiber sheet is configured to form a bridge at the formation fracture for lost circulation material to pile on the flexible fiber sheet and form a fluid plug, and wherein adding the lost circulation material comprises adding the lost circulation material such that the lost circulation material reaches the downhole location after the flexible sheet forms a bridge at the formation fracture.

4. The method of claim 1, wherein adding the lost circulation material comprises adding the lost circulation material to the drilling fluid and circulating the drilling fluid, through the drill string, in and out of the wellbore, and circulating the drilling fluid comprises flowing the drilling fluid from the inlet of the drill string to the outlet of the drill string and up an annulus of the wellbore to or near the surface of the wellbore.

5. The method of claim 1, wherein the flexible fiber sheet is releasably coupled to the pumpable dart with a gel dissolvable in the drilling fluid at the downhole location, and wherein the flexible fiber sheet is configured to separate from the pumpable dart when the dissolvable gel is dissolved in the drilling fluid, and wherein adding the lost circulation material comprises adding the lost circulation material such that the lost circulation material reaches the downhole location after the gel is dissolved and the flexible sheet is disengaged from the pumpable dart.

6. The method of claim 5, wherein the flexible fiber sheet is folded about a pin of the pumpable dart to engage with the dart, and wherein adding the lost circulation material comprises adding the lost circulation material such that the lost circulation material reaches the downhole location after the flexible fiber sheet is unfolded from the pin and disengaged from the dart.

7. The method of claim 5, wherein the dissolvable gel is disposed inside a pill that covers the plugging assembly, the pill comprising fluid configured to prevent the dissolvable gel from completely dissolving before exiting the drill string, the pill configured to be lost at the downhole location to expose the plugging assembly to the drilling fluid, and wherein adding the lost circulation material comprises adding the lost circulation material such that the lost circulation material reaches the downhole location after the gel is dissolved and the flexible sheet is disengaged from the pumpable dart.

8. The method of claim 7, wherein the fluid of the pill comprises an inhibited fluid polymer, and wherein adding the lost circulation material comprises adding the lost circulation material such that the lost circulation material reaches the downhole location after the inhibited fluid polymer is lost at the downhole location and the gel is dissolved.

9. The method of claim 7, wherein deploying the plugging assembly comprises:

disposing, inside a surface pumping head, the plugging assembly;

flowing, though a first portion of the pumping head downstream of the plugging assembly, a first portion of the pill;

moving the plugging assembly away from the surface pumping head toward the first portion of the pill;

flowing, through a second portion of the pumping head upstream of the plugging assembly, a second portion of the pill to cover the plugging assembly; and pumping, with the drilling fluid, the pumping assembly with the first and second portions of the pill.

10. The method of claim 1, wherein the flexible fiber sheet comprises pores to allow part of the drilling fluid to pass through the flexible fiber sheet into the formation fracture when the flexible fiber sheet is at the formation fracture, and wherein adding the lost circulation material comprises adding the lost circulation material such that the lost circulation material flows, with the drilling fluid, to the flexible fiber sheet to accumulate on the flexible fiber sheet and form a fluid plug.

11. The method of claim 1, wherein the dart comprises a shaft comprising a diameter smaller than an internal diameter of the drill string, a tip at a leading end of the shaft, and a radial shoulder extending from the shaft to an internal wall of the drill string, the dart pumpable by fluidic pressure applied at the radial shoulder, the flexible fiber sheet releasably coupled to the shaft and configured to detach from the dart at the downhole location upon leaving the drill string, and deploying the plugging assembly comprises deploying the plugging assembly such that the flexible fiber sheet flows, upon being released from the dart, to the formation fracture and the dart flows to a location away from the formation fracture.

12. The method of claim 11, the flexible fiber sheet is configured to flow, without the dart, at least partially into the formation fracture at a wall of the wellbore, blocking a fluid pathway into the fracture without substantially blocking the wellbore, and adding the loss circulation material comprises adding the loss circulation material to accumulate at the formation fracture without substantially blocking the wellbore such that the drill string is movable along the wellbore without drilling the loss circulation material.

13. A wellbore plugging assembly comprising:

a dart configured to be pumped, with drilling fluid, through a drill string from an inlet of the drill string disposed at or near a surface of a wellbore to an outlet of the drill string disposed at or near a downhole location of the wellbore, the drill string disposed at and stationary with respect to the wellbore, the dart configured to leave the drill string through the outlet at or near the downhole location where drilling fluid is lost through a formation fracture; and a flexible fiber sheet releasably coupled to the dart such that when the wellbore plugging assembly reaches the downhole location outside the drill string, the flexible fiber sheet is released from the dart to flow, with the drilling fluid, to the formation fracture to at least partially overlay the formation fracture, the flexible fiber sheet configured to form a bridge at the formation fracture for lost circulation material to accumulate on a portion of the flexible fiber sheet to at least partially fluidically plug the formation fracture.

14. The assembly of claim 13, wherein the flexible fiber sheet is wrapped to form a longitudinally continuous strip, the flexible fiber sheet configured to unwrap at the downhole location upon leaving the drill string and being exposed to the drilling fluid, before reaching the formation fracture.

15. The assembly of claim 13, wherein the flexible fiber sheet comprises pores to allow part of the drilling fluid to pass through the flexible fiber sheet into the formation fracture when the flexible fiber sheet is at the formation fracture, such that the lost circulation material flows, with the drilling fluid, to the flexible fiber sheet to accumulate on the flexible fiber sheet and form a fluid plug.

16. The assembly of claim 13, wherein the flexible fiber sheet is releasably coupled to and extends away from an uphole end of the dart with a gel dissolvable in the drilling fluid at the downhole location, and wherein the flexible fiber sheet is configured to separate from the pumpable dart when the dissolvable gel is dissolved in the drilling fluid.

17. The assembly of claim 16, wherein the flexible fiber sheet is folded about a pin of the pumpable dart to engage with the dart.

18. The assembly of claim 16, wherein the dissolvable gel is disposed inside a pill that covers the plugging assembly, the pill comprising fluid configured to prevent the dissolvable gel from completely dissolving before exiting the drill string, the pill configured to be lost at the downhole location to expose the plugging assembly to the drilling fluid.

19. The assembly of claim 18, wherein the fluid of the pill comprises an inhibited fluid polymer configured to be lost at the downhole location to expose the dissolvable gel to the drilling fluid.

20. A fluid loss plugging system comprising:

a dart, the dart configured to be pumped, with drilling fluid, through a drill string from an inlet of the drill string disposed at or near a surface of a wellbore to an outlet of the drill string disposed at or near a downhole location of the wellbore, the drill string disposed at and stationary with respect to the wellbore, the dart configured to leave the drill string through the outlet at or near the downhole location where drilling fluid is lost through a formation fracture;

a flexible fiber sheet releasably coupled to the dart such that when the plugging assembly reaches the downhole location outside the drill string, the flexible fiber sheet is released from the dart to flow, with the drilling fluid, to the formation fracture to at least partially overlay the formation fracture; and lost circulation material, the lost circulation material configured to flow through the drill string to the downhole location and to the formation fracture to accumulate on a portion of the flexible fiber sheet to at least partially fluidically plug the formation fracture.

21. The system of claim 20, wherein the flexible fiber sheet is wrapped or twisted to form a longitudinally continuous strip attached to and extending away from an uphole end of the dart, the flexible fiber sheet configured to unwrap or untwist at the downhole location upon leaving the drill string and being exposed to the drilling fluid, before reaching the formation fracture.

22. The system of claim 20, wherein the flexible fiber sheet is releasably coupled to the dart with a gel dissolvable in the drilling fluid at the downhole location such that the flexible fiber sheet separates from the pumpable dart when the dissolvable gel is dissolved in the drilling fluid.

* * * * *